United States Patent [19]

Worwag

[11] Patent Number: 5,014,386

[45] Date of Patent: May 14, 1991

[54] SUCTION NOZZLE, WITH A BRUSH, FOR A VACUUM CLEANER

[75] Inventor: Peter Worwag, Romanshorn, Switzerland

[73] Assignee: Düpro AG, Romanshorn, Switzerland

[21] Appl. No.: 463,613

[22] Filed: Jan. 11, 1990

[30] Foreign Application Priority Data

Jan. 11, 1989 [DE] Fed. Rep. of Germany ..... 3900577

[51] Int. Cl.[5] ..... A47L 9/00

[52] U.S. Cl. ..... 15/339; 15/377; 15/410; 15/DIG. 1

[58] Field of Search ..... 15/339, 344, 377, DIG. 1, 15/410

[56] References Cited

U.S. PATENT DOCUMENTS

| | | | |
|---|---|---|---|
| 3,872,539 | 3/1975 | Doyel | 15/344 |
| 3,999,243 | 12/1976 | La Pour | 15/344 |
| 4,884,314 | 12/1989 | Miner et al. | 15/344 |
| 4,920,608 | 5/1990 | Hult et al. | 15/344 X |

*Primary Examiner*—Chris K. Moore

*Attorney, Agent, or Firm*—Robert W. Becker & Associates

[57] ABSTRACT

A suction nozzle for a vacuum cleaner, including a brush that is disposed in the suction nozzle and is driven by a battery-powered electric motor. The suction nozzle is in flow communication with the vacuum cleaner via a suction hose. The suction nozzle is provided with a shaft for guiding and handling same. At least one bracket is disposed in the vicinity of the guide shaft for accommodating at least one battery for the electric motor.

6 Claims, 2 Drawing Sheets

SUCTION NOZZLE, WITH A BRUSH, FOR A VACUUM CLEANER

BACKGROUND OF THE INVENTION

The present invention relates to a suction nozzle for a vacuum cleaner, including a brush that is disposed in the suction nozzle and is driven by a battery-powered electric motor, with the suction nozzle being in flow communication with the vacuum cleaner via a suction hose, and with the suction nozzle being provided with a shaft for guiding and handling same.

For cleaning especially textile or fabric floor surfaces suction nozzles are used in conjunction with a vacuum cleaner; the suction nozzles have a rotatably driven, cylindrical brush. This brush is mounted in the suction nozzle in such a way that during the cleaning process its bristles penetrate into the surface of the textile floor covering, so that in addition to the vacuum cleaning, an additional mechanical loosening of adhering dirt particles is effected.

The drive of the rotating, generally cylindrical brushes is effected with domestic units, and especially with commercial vacuum cleaners, via an electric motor that is accommodated within the housing of the suction nozzle. Power is generally supplied to the motor via a detachable power line that is connected to a connector socket on the vacuum cleaner. This connecting line, which connects the drive motor of the suction nozzle with the power driven vacuum cleaner, can get in the way, especially with vacuum cleaners where the suction nozzle is connected to the vacuum cleaner by a long suction hose, for example a suction pipe and a suction hose, as is the case with larger domestic vacuum cleaners and in particular with commercial vacuum cleaners. With such units, the connecting line for the suction nozzle is guided along the suction hose and the suction pipe to the vacuum cleaner, where special holders or brackets, for example retaining rings or the like, are provided that securely hold the connecting line for the suction nozzle in place on the suction hoses or pipes.

Constructions are known where the power supply line to the suction nozzle is integrated directly into the suction hose that connects the nozzle and vacuum cleaner. However, since such a guidance of the electric line requires special measures for safety reasons, it is therefore complicated and expensive, and is furthermore susceptible to problems.

With one heretofore known vacuum cleaner (EP-A2 0 267 056), the electric drive motor is powered by a battery that is accommodated within the housing of the suction nozzle. The drawback of this arrangement is that the size of the battery, and hence the capacity thereof, is very limited due to the limited space conditions, especially since in many cases it is necessary to also install a charger for charging the battery. If the charger is eliminated, it is necessary to provide a separate charging unit and to connect the suction nozzle to this unit for recharging the batteries; in such a case, the suction nozzle cannot be used during the charging process. If the battery is disposed in the suction nozzle, especially in conjunction with a generally necessary charger, the overall center of gravity of the unit is disadvantageously shifted downwardly, and the weight of the unit is undesirably increased. Such units are therefore heavy and difficult to handle. Building the batteries in, possibly along with a charger, additionally undesirably limits to a great extent the possible structural configuration of the overall vacuum cleaner.

It is an object of the present invention to embody a suction nozzle of the aforementioned general type in such a way that these drawbacks are avoided and a manageable suction nozzle having a favorably disposed center of gravity is provided, with the configuration of the actual suction nozzle not being adversely affected by having to build in batteries, with the inventive configuration furthermore enabling easy access to the batteries for easy replacement thereof.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
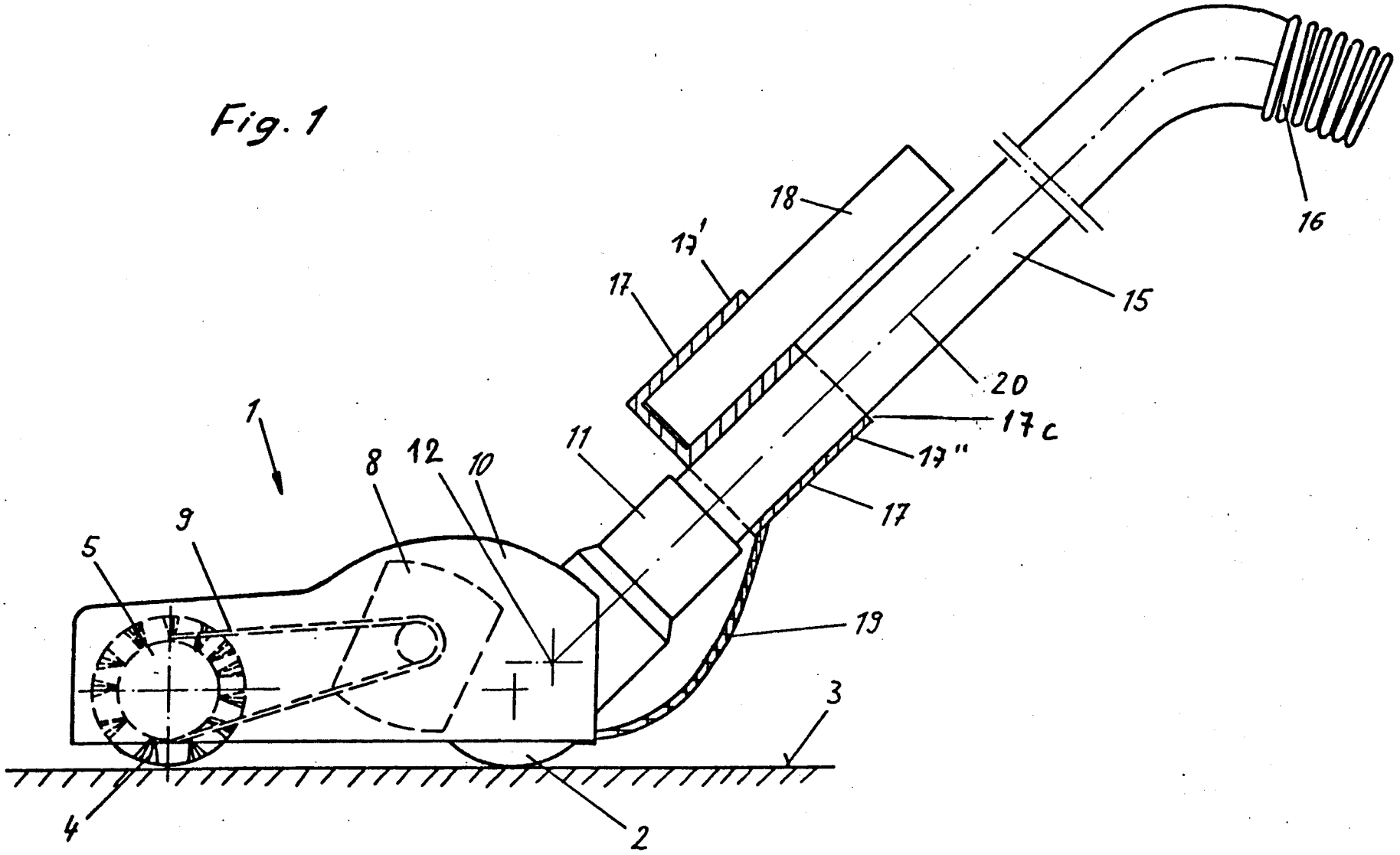
FIG. 1 is a partially cross-sectioned side view of one exemplary embodiment of the inventive suction nozzle in an operating position, with the inventive battery holder being provided on the guide shaft.

The suction nozzle of the present invention is characterized primarily by at least one holder or bracket that is disposed in the vicinity of the guide shaft for accommodating at least one battery for the electric motor.

Since pursuant to the invention the battery or several batteries for the drive motor of the suction nozzle are disposed in a special bracket on the guide shaft of the suction nozzle, the structural configuration of the suction nozzle itself can be adapted to the requirements of use, for example with regard to its weight, the center of gravity, and its outer shape, all without limitation. In addition, disposing the bracket on the guide shaft favorably shifts the center of gravity of the overall unit, so that the additional weight of the batteries is advantageously transferred directly to the support rollers. In addition, the bracket itself can be easily and cheaply produced, for example as a molded part, and in particular in such a way that the clamping connections necessary for holding the batteries, as well as the electrical contacts, can be directly provided in the bracket itself. The repeatedly chargeable battery, or several such batteries, can be easily inserted and again removed from the inventive bracket, whereby the actual receiving means for the battery, and a connector sleeve that is provided for mounting the bracket on the guide shaft of the unit, can be integrally produced and can be mounted on the guide shaft without difficulty. Due to the inventive arrangement of the battery bracket, the suction hose, which is connected in a known manner with the vacuum cleaner, experiences no structural alteration compared to the heretofore known units. It is advantageous to dispose the bracket in the immediate vicinity of the connector on the outer surface of that part of the suction hose that is embodied as the guide shaft. As a result, the greatest part of the weight of the battery and the bracket is conducted along the shortest path to the support rollers, so that despite battery operation, handling of the unit is not made more difficult.

In order to increase the electrical capacity, several brackets for several batteries can be provided on the guide shaft. In this connection, it is preferable to embody the charger for the batteries as a separate unit that is separate from the suction nozzle, so that during operation with the suction nozzle, discharged batteries can be recharged. By means of a switching mechanism, the already charged batteries that are provided in the bracket on the guide shaft can be successively connected, preferably via an automatic switching process. It is also conceivable to simultaneously connect several batteries together for operating the electric motor in the event that the main unit requires this much power. In addition, the operator can be easily made aware of the respective charging or operating state by means of an indicator.

Further specific features of the present invention will be described in detail subsequently.

DESCRIPTION OF PREFERRED EMBODIMENTS

Referring now to the drawings in detail, a suction nozzle 1 having a brush rests upon a fabric or textile surface 3 that is to be cleaned via support rollers 2; the bristles 4 of the rotating brush 5 penetrate into the textile surface 3. The brush roller 5 is driven by the electric motor 8 via the belt drive 9. Pivotably mounted at the rear end 10 of the suction nozzle 1, about the axis 12, is a connector 11. To be able to effect suction, a hollow guide shaft 15, which is part of the suction hose 16, is positively connected to the connector 11, preferably via a plug-type connection. The suction hose 16 connects the suction nozzle 1 to a non-illustrated vacuum cleaner. Mounted on the guide shaft 15 in the vicinity of the connector 11 is a holder or bracket 17 for receiving one or more batteries 18. The bracket 17 is provided with non-illustrated contacts that, when the battery 18 is placed in the bracket 17, are connected with cooperating contacts of the battery. Via the connecting line 19, the battery 18 is electrically connected to the drive motor 8.

In order to let an operator know when a battery has become discharged and must be recharged, a signal light is provided at a suitable location. The battery that has to be recharged is merely withdrawn from the bracket 17, and a charged battery is inserted in place thereof. The charging is effected in a known manner by means of a non-illustrated charger. In order to increase the operating capacity of the suction nozzle 1, two or more brackets can be provided on the guide shaft 15 for two or more batteries 18. The bracket 17 has a receiving means 17' in which the battery 18 is frictionally held, for example via non-illustrated clamping means. The receiving means 17', in which are provided the non-illustrated electrical contacts, is preferably disposed parallel and symmetrical to the axis 20 o±the connector 11 and has an approximately U-shaped cross-sectional configuration, so that the operator can insert and withdraw the battery or batteries in a straightforward manner from above into and out of the insertion opening **17*c* of the pocket-like receiving means 17'. In addition to the receiving means 17', the bracket 17, which is made, for example, as an injection molded part, is provided with a connector sleeve 17'' that is preferably integrally formed with the receiving means 17'; the connector sleeve 17'' can be secured to the outer periphery of the guide shaft 15** by being pressed or merely clamped thereon. This configuration permits an easy insertion and a straightforward handling when the batteries are inserted or removed.

As a consequence of the symmetrical arrangement of the receiving means 17' to the connector 11, an optimum distribution of weight results, and the operator is also provided with an easy accessibility for handling the batteries. The inventive construction makes it easy to remove the battery 18 from the contact portion of the bracket 17 after the discharge !limit has been reached, and to replace this discharged battery with a charged battery 18. This charged battery could be taken from a supply area that is integral with the bracket 17 and is not shown in the drawing. This would involve portions of the bracket that do not require electrical contacts or connecting lines. These portions serve merely to hold spare batteries. One or more charged batteries 18 that are stored on the guide shaft 15 in brackets 17 can be successively disconnected upon discharge via a manually or automatically controlled switching means; at the same time, via the same control means, a charged battery can be connected.

Figure 2:
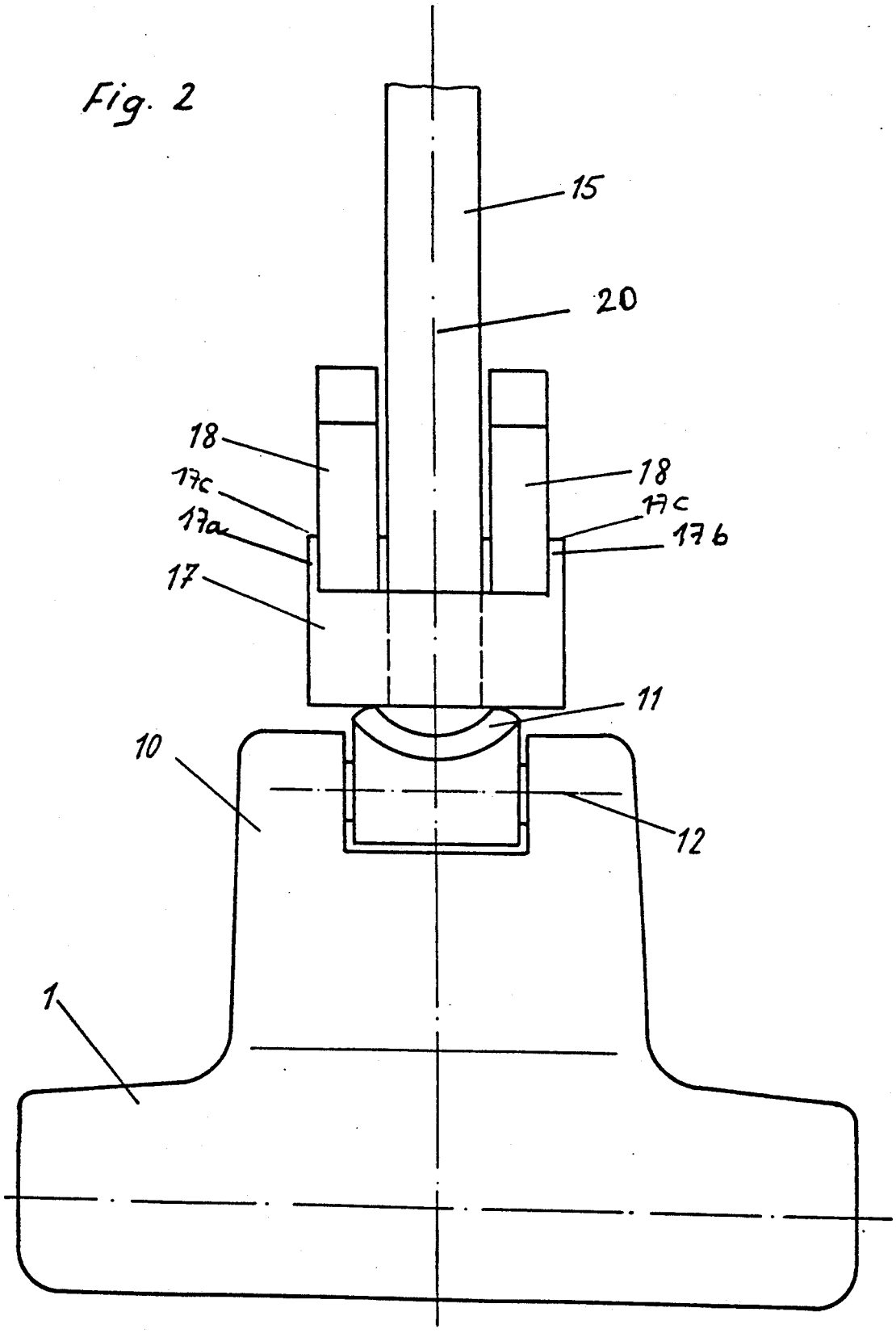
FIG. 2 is a view from above of a second exemplary embodiment of the inventive suction nozzle, again in an operating position, with a holder or bracket for two batteries being provided.

The embodiment illustrated in FIG. 2 shows a lateral arrangement of two batteries 18 in the bracket 17, which is divided into associated portions **17*a* and 17*b*. The parallel portions 17*a* and 17*b* are similarly disposed symmetrically relative to the axis 20 of the connector 11, and preferably in such a way that they are disposed in a plane that passes through the axis 20** and extends at an angle to the vertical.

The lateral mounting of the bracket 17 illustrated in FIG. 2 has the advantage that when the suction nozzle is operated under furniture or the like, the bracket 17 takes up no additional space, thus not obstructing the operation of the suction nozzle while at the same time preventing the bracket 17 from resting upon the textile surface 3.

A switching mechanism is installed in the bracket 17 for connecting and disconnecting batteries that are placed therein. During axial insertion of the battery 18 into the bracket 17, the switching mechanism connects the battery. By again pressing the battery 18 axially into the receiving means 17' or **17*a*, 17*b***, the battery can again be disconnected. Such a switch construction offers the advantage that the switch elements can be easily adapted to the relatively high direct current, which draws a strong arc.

In the two embodiments illustrated in FIGS. 1 and 2, the guide shaft 15 is part of the suction hose 16. However, it is also conceivable, with a continuous flexible hose and a guide that is separate therefrom, to dispose the bracket either in a lower, less flexible portion of the hose, or on a frame part that is separate from the hose and the suction nozzle.

The present invention is, of course, in no way restricted to the specific disclosure of the specification and drawings, but also encompasses any modifications within the scope of the appended claims.

What is claim is:

1. In a suction nozzle device for a vacuum cleaner comprising a hollow handle suction tube and a suction nozzle having a connecting socket, with a lower end of said handle suction tube being inserted into said connecting socket to achieve a plug connection between said suction nozzle and said handle suction tube, with said suction nozzle being in flow communication with said vacuum cleaner via a suction hose disposed at an upper end of said handle suction tube opposite said suction nozzle, with said suction nozzle enclosing a power driven rotary brush and a battery powered electric motor for operating said rotary brush, the improvement wherein:

a holding bracket is disposed at said handle suction tube in a vicinity of said connecting socket for holding at least one battery that is electrically connected to said electric motor via a supply lead.

2. A suction nozzle device according to claim 1, in which said holding bracket comprises a receiving compartment that is adapted to a cross-sectional configuration of said batteries, and a connector sleeve for placement on said handle suction tube.

3. A suction nozzle device according to claim 2, in which said receiving compartment and said connector sleeve are a single piece.

4. A suction nozzle device according to claim 2, in which said connecting socket has a central axis, and said receiving compartment is disposed parallel thereto.

5. A suction nozzle device according to claim 4, in which said receiving compartment has a U-shaped cross-sectional configuration and has an insertion opening, for said battery, that is disposed remote from said connecting socket.

6. A suction nozzle device according to claim 4, in which said holding bracket comprises at least two receiving compartments, which are disposed symmetrically relative to said central axis of said connecting socket.

* * * * *